US006058858A

United States Patent [19]

Belin et al.

[11] Patent Number: 6,058,858

[45] Date of Patent: May 9, 2000

[54] CIRCULATING FLUIDIZED BED REACTOR WITH PLURAL FURNACE OUTLETS

[75] Inventors: Felix Belin, Brecksville; David E. James, Barberton; David J. Walker; Kiplin C. Alexander, both of Wadsworth, all of Ohio

[73] Assignee: The Babcock & Wilcox Company, New Orleans, La.

[21] Appl. No.: 09/077,483

[22] PCT Filed: Nov. 29, 1996

[86] PCT No.: PCT/US96/19039

§ 371 Date: Jun. 29, 1998

§ 102(e) Date: Jun. 29, 1998

[87] PCT Pub. No.: WO97/20172

PCT Pub. Date: Jun. 5, 1997

Related U.S. Application Data

[60] Provisional application No. 60/008,253, Dec. 1, 1995.

[51] Int. Cl.[7] ..... F23G 5/00; F23G 7/00; F23J 3/00

[52] U.S. Cl. ..... 110/245; 110/204; 110/216; 122/4 D; 55/443; 55/464

[58] Field of Search ..... 110/235, 245, 110/342, 344, 345, 204, 216, 217, 165 A; 55/440, 443, 444, 462, 464; 122/4 D

[56] References Cited

U.S. PATENT DOCUMENTS

| | | | |
|---|---|---|---|
| 4,599,952 | 7/1986 | Meier | 110/216 |
| 4,761,131 | 8/1988 | Abdulally | 431/7 |
| 4,891,052 | 1/1990 | Belin et al. | 55/429 |
| 4,992,085 | 2/1991 | Belin et al. | 55/444 |
| 5,215,042 | 6/1993 | Beisswenger et al. | 122/4 D |
| 5,343,830 | 9/1994 | Alexander et al. | 122/4 D |
| 5,370,084 | 12/1994 | Skowyra et al. | 122/4 D |
| 5,759,495 | 6/1998 | Hyppanen | 122/4 D X |

FOREIGN PATENT DOCUMENTS

| | | |
|---|---|---|
| 26 18 290 A1 | 12/1976 | Germany . |
| 762421 | 4/1976 | South Africa . |
| 2011594 | 7/1979 | United Kingdom . |

OTHER PUBLICATIONS

Belin et al., "Repowering of Ukrainian Power Plants with CFB Boilers", PowerGen Americas '95 Conference in Anaheim, CA, pp 1–18, Dec. 1995.

*Primary Examiner*—Ira S. Lazarus
*Assistant Examiner*—Ljiljana V. Ciric
*Attorney, Agent, or Firm*—R. J. Edwards; Eric Marich

[57] ABSTRACT

A circulating fluidized bed (CFB) reactor or combustor having an internal impact type primary particle separator which provides for internal return of all primary collected solids to a bottom portion of the reactor or combustor for subsequent recirculation without external and internal recycle conduits. The CFB reactor enclosure or furnace is provided with plural furnace outlets. This construction permits increased furnace depths and reduced furnace widths, resulting in a compact design.

10 Claims, 5 Drawing Sheets

CIRCULATING FLUIDIZED BED REACTOR WITH PLURAL FURNACE OUTLETS

This appln is a 371 of PCT/US96/19039 filed Nov. 29, 1996, also claims the benefit of U.S. Provisional No. 60/008,253 filed Dec. 1, 1995.

FIELD OF THE INVENTION

The present invention relates, in general, to circulating fluidized bed (CFB) reactors or combustors having an internal impact-type primary particle separator which provides for the internal return of all primary collected solids to a bottom portion of the reactor or combustor for subsequent recirculation without external and internal recycle conduits. In particular, it relates to an improved CFB reactor or combustor design wherein the CFB reactor enclosure or furnace is provided with plural furnace outlets. This construction permits increased furnace depths and reduced furnace widths, resulting in a compact, low-cost design particularly suitable for new construction or for replacement of existing fossil-fueled steam generator capacity, whether or not such existing capacity is of the CFB type.

BACKGROUND OF THE INVENTION

Throughout the several drawings forming a part of this disclosure, like numerals represent the same or functionally similar elements. FIGS. 1 and 2 are schematics of known CFB boiler systems used in the production of steam for industrial process requirements and/or electric power generation. Referring to FIG. 1, fuel and sorbent are supplied to a bottom portion of a furnace 1 contained within enclosure walls 2, which are normally fluid cooled tubes. Air 3 for combustion and fluidization is provided to a windbox 4 and enters the furnace 1 through apertures in a distribution plate 5. Flue gas and entrained particles/solids 6 flow upwardly through the furnace 1, releasing heat to the enclosure walls 2. In most designs, additional air is supplied to the furnace 1 via overfire air supply ducts 7.

The system of FIG. 1 provides two stages of particle separation: in-furnace impact-type particle separators or U-beams 13 and external impact-type particle separators or U-beams 14. Since the particular designs of such U-beams configurations and their functions have been previously disclosed (see, for example, U.S. Pat. Nos. 4,992,085 and 4,891,052 to Belin, et al. and U.S. Pat. No. 5,343,830 to Alexander et al., all assigned to The Babcock & Wilcox Company), and they will not be discussed in further detail. Suffice it to say that the in-furnace U-beams return their collected particles directly into the furnace 1, while the external U-beams return their collected particles into the furnace via the particle storage hopper 11 and L-valve 12, collectively referred to as a particle return system 15. An aeration port 16 supplies air for controlling the flow rate of solids or particles through the L-valve 12.

The flue gas and solids 6 pass into a convection pass 17 which contains convection heating surface 18. The convection heating surface 18 can be evaporating, economizer, or superheater as required.

Although not shown in connection with the FIG. 1 system, an air heater would also be provided downstream of the convection pass 17 to extract further heat from the flue gas and solids 6. A multiclone dust collector (also not shown) would also be supplied to recycle solids back to a lower portion of the furnace enclosure.

In CFB reactors, the reacting and non-reacting solids are entrained within the reactor enclosure by the upward gas flow which carries solids to the exit at the upper portion of the reactor where the solids are separated by the internal and/or external particle separators. The collected solids are returned to the bottom of the reactor commonly by means of internal or external conduits. In the system of FIG. 1, the L-valve 12 is a pressure seal device that is needed as a part of the return conduit due to the high pressure differential between the bottom of the reactor and the particle separator outlet. The primary separator at the reactor exit collects most of the circulating solids (typically from 95% to 99.5%). In many cases an additional (secondary) particle separator and associated recycle means are used to minimize the loss of circulating solids due to inefficiency of the primary separator.

The internal impact-type particle separators are comprised of a plurality of concave impingement or impact members supported within the furnace enclosure and extending vertically in at least two rows across the furnace exit opening. Collected particles fall unobstructed and unchannelled underneath the collecting members along the enclosure wall. This separator has proven effective in increasing the average density in a CFB combustor without increasing the flow of externally collected and recycled solids, while still providing simplicity of the separator structural arrangement, absence of clogging, and uniformity of the gas flow at the furnace exit. The latter effect is important to prevent local erosion of the enclosure walls and in-furnace heating surfaces like wingwalls caused by impingement of a high velocity gas-solids stream.

In this known embodiment, the internal impact-type particle separator, comprised of two rows of impingement members, is typically used in combination with a downstream external impact-type particle separator from which collected solids are returned to the furnace by an external conduit. The external impact-type particle separator and associated particle return means, e.g., the particle storage hopper and L-valve of FIG. 1, are needed since the efficiency of the internal impact-type particle separator, comprised typically of two rows of impingement members, is not sufficient to prevent excessive solids carryover to the downstream convection gas pass which may cause erosion of the convection surfaces and an increase of the required capacity of the secondary particle collection/recycle equipment.

U.S. Pat. No. 5,343,830 to Alexander et al., also assigned to The Babcock & Wilcox Company, discloses an entirely new type of CFB reactor or combustor which provides for internal return of all primary collected solids to a bottom portion of the reactor or combustor for subsequent recirculation without external and internal recycle conduits. FIG. 2 is a schematic representation of such an internal recycle, circulating fluidized bed (IR-CFB) boiler, generally designated 30.

In FIG. 2, the front of the CFB boiler 30 or reactor enclosure 32 is defined as the left hand side of FIG. 2, the rear of the CFB boiler 30 or reactor enclosure 32 is defined as the right hand side of FIG. 2, and the width of the CFB boiler 30 or reactor enclosure 32 is perpendicular to the plane of the paper on which FIG. 2 is drawn.

The CFB boiler 30 has a furnace or reactor enclosure 32, typically rectangular in cross-section, and partially defined by fluid cooled enclosure walls 34. The enclosure walls are typically tubes separated from one another by a steel membrane to achieve a gas-tight enclosure 32. The reactor enclosure 32 is further defined by having a lower portion 36, an upper portion 38, and an exit opening 40 located at an outlet of the upper portion 38. Fuel, such as coal, and sorbent, such as limestone, indicated at 42, are provided to the lower portion 36 in a regulated and metered fashion by any conventional means known to those skilled in the art. By way of example and not limitation, typical equipment that would be used include gravimetric feeders, rotary valves and injection screws. Primary air, indicated at 44, is provided to the lower portion 36 via windbox 46 and distribution plate 48 connected thereto. Bed drain 50 removes ash and other debris from the lower portion 36 as required, and overfire air supply ports 52,54 supply the balance of the air needed for combustion.

A flue gas/solids mixture 56 produced by the CFB combustion process flows upwardly through the reactor enclosure 32 from the lower portion 36 to the upper portion 38, transferring a portion of the heat contained therein to the fluid cooled enclosure walls 34. A primary, impact-type particle separator 58 is located within the upper portion 38 of the reactor enclosure 32, and comprises four to six rows of concave impingement members 60, arranged in two groups—an upstream group 62 having two rows and a downstream group 64 having two to four rows, preferably three rows. Members 60 are supported from roof 66 of the reactor enclosure 32 and are non-planar; they may be U-shaped, E-shaped, W-shaped or any other shape as long as they have a concave surface. The first two rows of members 60 are staggered with respect to each other such that the flue gas/solids 56 passes through them enabling the entrained solid particles to strike this concave surface; the second two to four rows of members 60 are likewise staggered with respect to each other. The upstream group 62 of impingement members 60 will collect particles entrained in the gas and cause them to free fall internally and directly down towards the bottom portion 36 of the reactor enclosure 32, against the crossing flow of flue gas/solids 56.

Impingement members 60 are positioned within the upper portion 38 of the reactor enclosure 32 fully across and just upstream of exit opening 40. Besides covering exit opening 40, each impingement member 60 in downstream group 64 also extends beyond a lower elevation or workpoint 68 of exit opening 40 by approximately one foot. In the preferred embodiment, however, and in contrast to the impingement members 60 of upstream group 62, the lower ends of the impingement members 60 in downstream group 64 extend into a cavity means 70, located entirely within the reactor enclosure 32, for receiving collected particles as they fall from the downstream group 64.

The particles collected by downstream group 64 must also be returned to the bottom portion 36 of the reactor enclosure 32. Returning means 72 are thus provided, connected to the cavity means 70 and also located entirely within the reactor enclosure 32. Returning means 72 returns particles from the cavity means 70 directly and internally into the reactor enclosure 32 so that they fall unobstructed and unchanneled down along the enclosure walls 34 to the bottom portion 36 of the reactor enclosure 32 for subsequent recirculation. In this embodiment, the cavity means 70 functions as more of a temporary transfer mechanism, rather than as a place where particles are stored for any significant period of time. By causing the particles to fall along the enclosure walls 34, the possibility of reentrainment in the upwardly flowing gas/solids 56 passing through the reactor enclosure 32 is minimized.

Connected to the exit opening 40 of the reactor enclosure 32 is convection pass 74. After passing first across upstream group 62 and then across downstream group 64, the flue gas/solids 56 (whose solids content has been markedly reduced, but which still contains some fine particles not removed by the primary, impact-type particle separator 58) exit the reactor enclosure 32 and enters convection pass 74. Located within the convection pass 74 is the heat transfer surface 75 required by the particular design of CFB boiler 30. Various arrangements are possible, and the reader is referred to U.S. Pat. No. 5,343,830 for further details. Different types of heat transfer surface 75, such as evaporating surface, economizer, superheater, or air heater and the like could also be located within the convection pass 74, limited only by the process steam or utility power generation requirements and the thermodynamic limitations known to those skilled in the art.

After passing across all or a part of the heating surface in the convection pass 74, the flue gas/solids 56 is passed through a secondary particle separation device 78, typically a multiclone dust collector, for removal of most of the particles 80 remaining in the gas. These particles 80 are also returned to the lower portion 36 of the reactor enclosure 32 by means of a secondary particle return system 82. The cleaned flue gas is then passed through an air heater 84 used to preheat the incoming air for combustion provided by a fan 86. Cooled and cleaned flue gas 88 is then passed to a final particle collector 89, such as an electrostatic precipitator or baghouse, through an induced draft fan 90 and stack 91.

Known IR-CFBs of the type disclosed in Alexander et al. have a single furnace exit opening 40 associated with the arrangement of impact-type primary particle separators. In these furnaces, the furnace dimension perpendicular to the plane of the exit opening 40, i.e., the furnace depth D, is limited in size to a value equal to approximately one-half of the maximum height of the primary impact-type particle separators or U-beams. As indicated above, the maximum height of the U-beams is determined by consideration of the maximum allowable stresses in the U-beams and the particle collection efficiency, which tends to decrease as the U-beams length increases. As a practical limit, the furnace depth is thus limited to a value of approximately 15 feet. For IR-CFB furnaces of large capacity, (100–200 $MW_e$ and larger) this furnace depth limitation results in a prohibitively large furnace aspect ratio (defined as the ratio of the furnace width divided by the furnace depth).

Additionally, in such known IR-CFB designs, the fuel is typically fed by multiple feeders through the furnace front wall. Limestone or sorbent is fed together with fuel or through separate injection points in the front wall and sometimes the rear wall. Solids are also recirculated from the secondary particle separator through the rear wall, and to improve mixing in the lower furnace and to enhance solids entrainment at partial loads, the furnace is generally tapered in its lower part. Secondary air nozzles are also installed at the front and rear walls in this tapered portion of the furnace.

It is thus apparent that an improved IR-CFB reactor or combustor suitable for larger steam generator capacities could be obtained if the furnace depth limitation could be overcome.

SUMMARY OF THE INVENTION

A central purpose of the present invention is to provide a CFB reactor or combustor, preferably an improved IR-CFB type reactor or combustor, with an increased furnace depth and a decreased furnace width which results in a more compact (better furnace aspect ratio) and economical design. The present invention achieves this result by providing plural furnace exits, preferably two, located on opposing front and rear furnace walls at an upper portion of the furnace reactor enclosure. This construction effectively doubles the furnace exit cross-sectional area for a given unit width, and therefore allows the furnace depth to be doubled. Height limitations for U-beams forming the impact-type primary particle separators at the furnace exits are thus kept within allowable limits.

Accordingly, one aspect of the present invention is drawn to a circulating fluidized bed reactor. A reactor enclosure is provided, partially defined by front and rear enclosure walls and having a bottom portion, an upper portion, and an exit opening located at an outlet of the upper portion on each of the front and rear enclosure walls. Primary, impact-type particle separator means are located within the upper portion of the reactor enclosure at both exit openings on each of the front and rear enclosure walls, for collecting particles entrained within a gas flowing within the reactor enclosure from the lower portion to the upper portion, causing them to fall towards the bottom portion of the reactor. Cavity or particle receiving means, connected to each of the primary, impact-type particle separator means at both exit openings on each of the front and rear enclosure walls and located entirely within the reactor enclosure, are provided for receiving collected particles as they fall from the primary, impact-type particle separator means. Finally, returning particle means, connected to each of the cavity particle receiving means at both exit openings on each of the front and rear enclosure walls and located entirely within the reactor enclosure, are provided for returning particles from the cavity means directly and internally into the reactor enclosure so that they free fall unobstructed and unchanneled down along the enclosure walls to the bottom portion of the reactor for subsequent recirculation.

The various features of novelty which characterize the invention are pointed out with particularity in the claims annexed to and forming a part of this disclosure. For a better understanding of the invention, its operating advantages and the specific benefits attained by its uses, reference is made to the accompanying drawings and descriptive matter in which preferred embodiments of the invention are illustrated.

BRIEF DESCRIPTION OF THE DRAWINGS

FIGS. 5–10 illustrate alternative configurations for providing the flue gas/solids from the furnace to a single, common convection pass containing all the downstream heating surfaces via separate intermediate flue passages, wherein:

FIG. 5 is a schematic sectional view of an upper portion of the CFB reactor or combustor;

FIG. 6 is a sectional view of FIG. 5 taken in the direction of arrows 6—6;

FIG. 7 is a schematic plan view, partly in section, of FIG. 5; and

FIGS. 8–10 are are partial schematic sectional views of FIG. 7, taken in the direction of arrows 8—8, 9—9, and 10—10, respectively, and illustrate structural variations on how the flue gas/solids could be provided to the separate intermediate flue passages and the single, common convection pass.

DESCRIPTION OF THE PREFERRED EMBODIMENTS

As used herein, the term CFB combustor refers to a type of CFB reactor where a combustion process takes place. While the present invention is directed particularly to boilers or steam generators which employ CFB combustors as the means by which the heat is produced, it is understood that the present invention can readily be employed in a different kind of CFB reactor. For example, the invention could be applied in a reactor that is employed for chemical reactions other than a combustion process, or where a gas/solids mixture from a combustion process occurring elsewhere is provided to the reactor for further processing, or where the reactor merely provides an enclosure wherein particles or solids are entrained in a gas that is not necessarily a byproduct of a combustion process.

Figure 1:
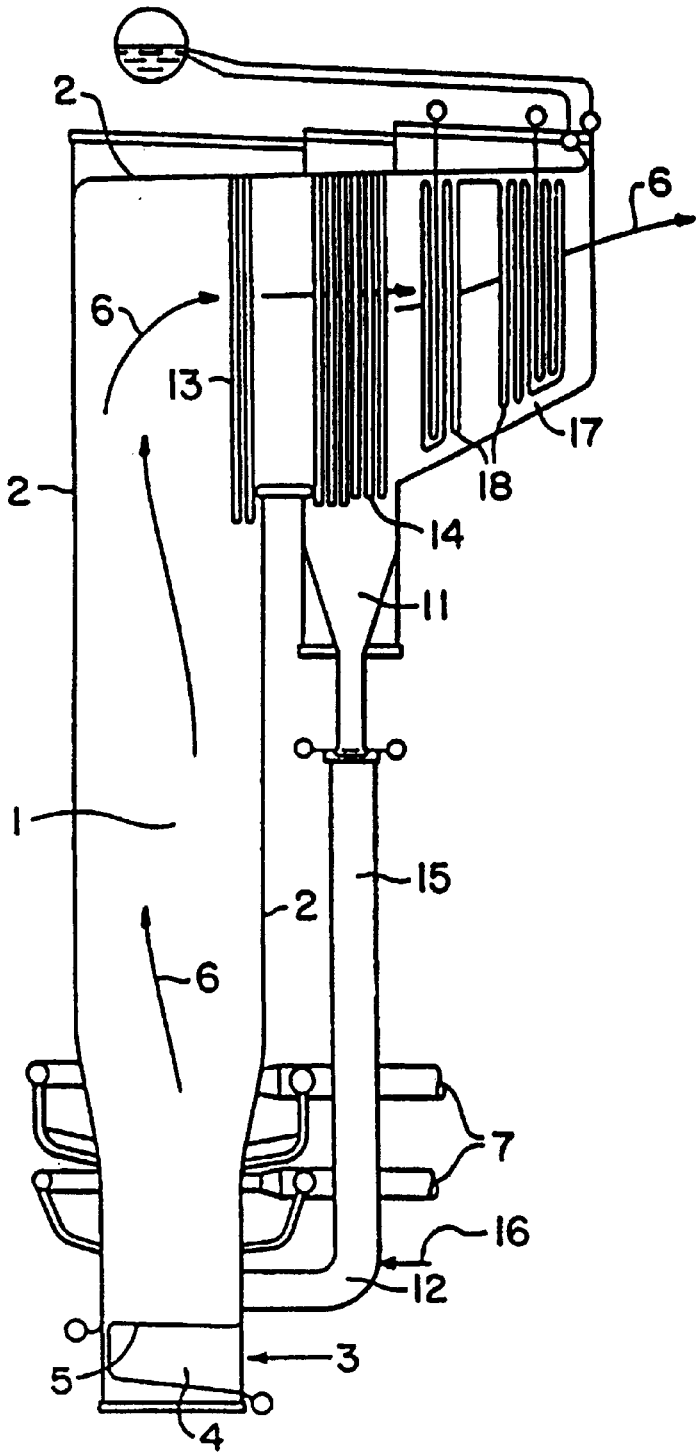
FIG. 1 PRIOR ART
FIG. 1 is a schematic of a known circulating fluidized bed (CFB) boiler system having both internal and external impact-type primary particle separators and a non-mechanical L-valve.
Figure 2:
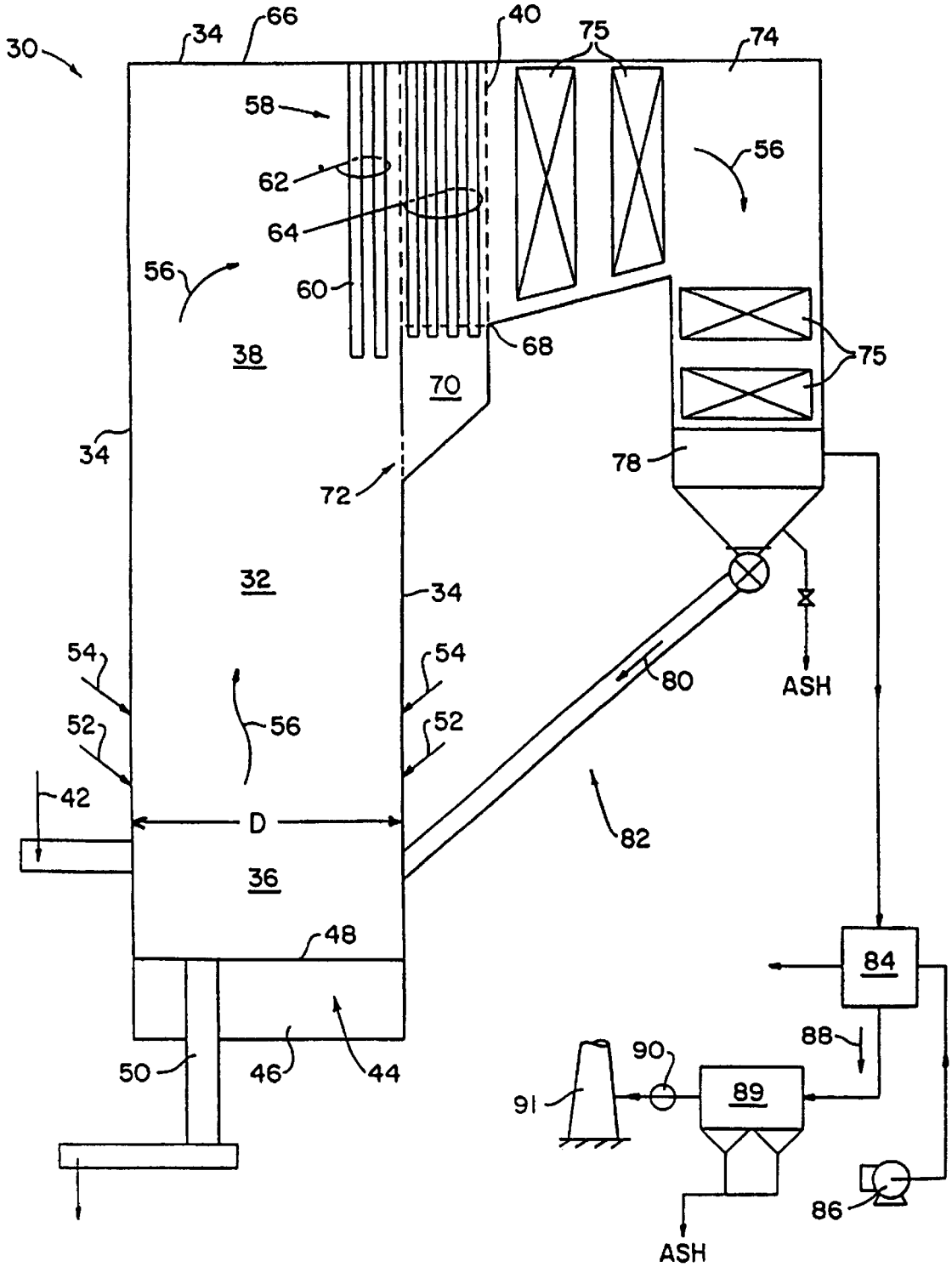
FIG. 2 PRIOR ART
FIG. 2 is a schematic sectional side view of another known CFB boiler of the type disclosed in U.S. Pat. No. 5,343,830 to Alexander et al.
Figure 3:
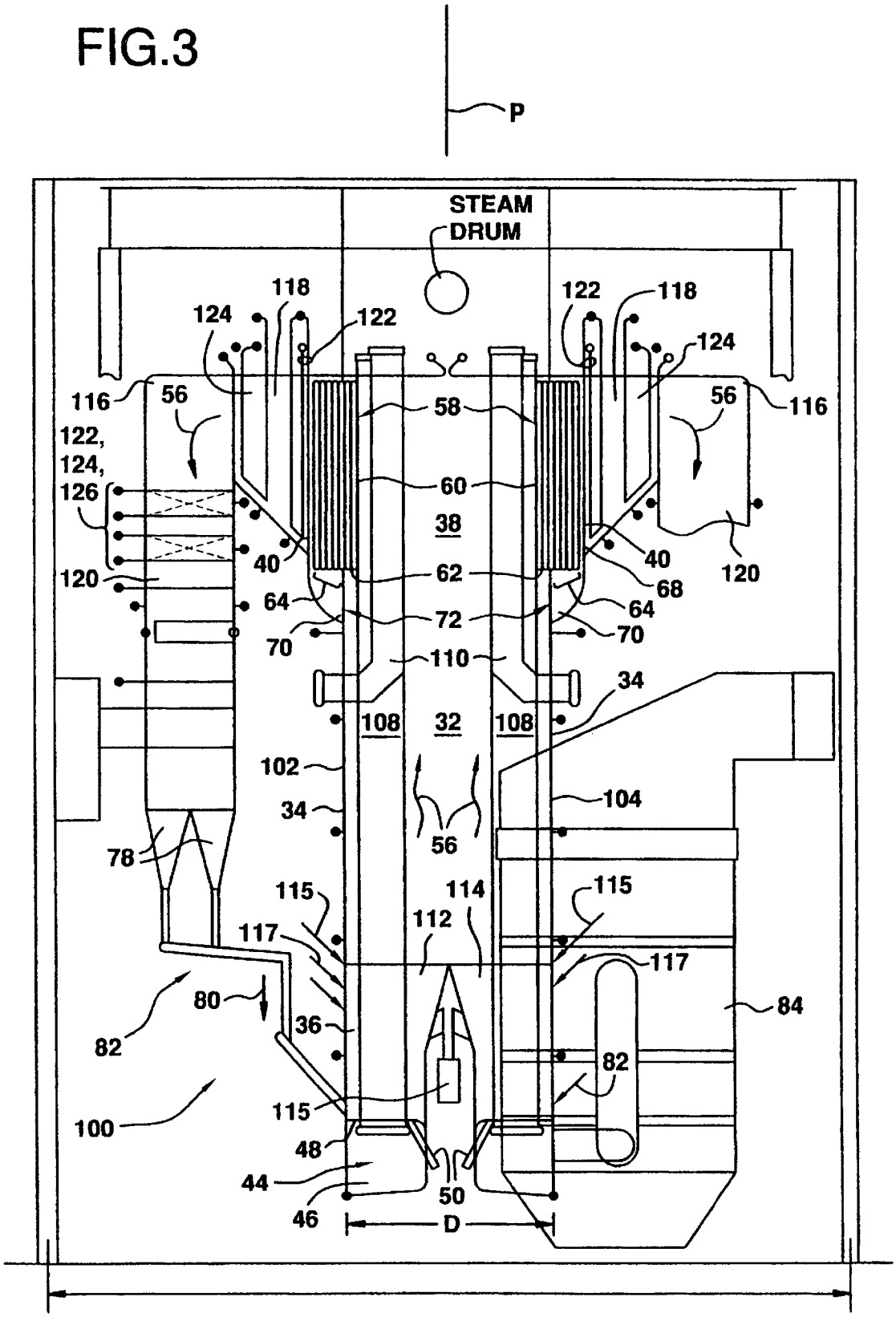
FIG. 3 is a schematic sectional side view of an improved CFB reactor or combustor according to the present invention.
Figure 4:
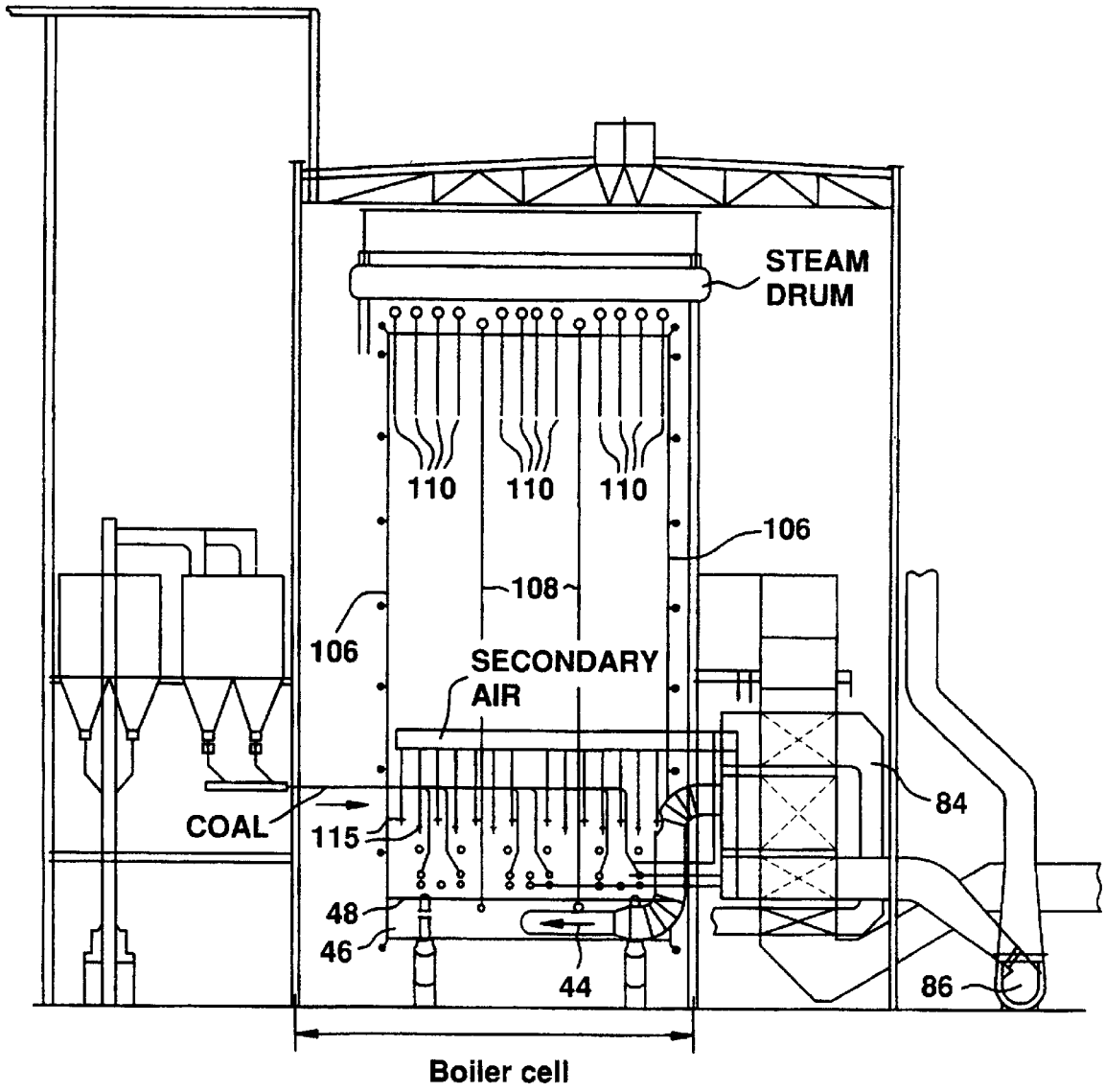
FIG. 4 is a schematic side view of FIG. 3.

Referring to the drawings generally, wherein again like numerals designate the same or functionally similar elements throughout the several drawings, and to FIGS. 3 and 4 in particular, there is shown a first embodiment of the improved CFB of the present invention, generally designated 100. For the sake of simplicity, the fundamental difference between the present invention and CFB or IR-CFB combustors or reactors of the prior art is the provision of plural furnace exits 40, preferably two in number, located on opposing front 102 and rear 104 furnace enclosure walls 34 at an upper portion 38 of the furnace reactor enclosure 32. The furnace enclosure walls 34 are typically tubes separated from one another by a steel membrane to achieve a gas-tight enclosure 32. This construction effectively doubles the furnace exit cross-sectional area for a given unit width, and therefore allows the furnace depth D to be doubled. Height limitations for U-beams 60 provided in the upper portion 38 of the reactor enclosure 32, and which are now provided for both furnace exits 40, can be maintained within allowable design limits. In essence, the CFB 100 itself is now substantially symmetrical about a vertical centerline plane P passing through the side walls 106 of the reactor enclosure 32, each half of the CFB 100 being a mirror-image of the other. As required, division wall surface 108 (typically a boiler or evaporative surface) and/or wingwall surface 110 (typically a superheater or reheater surface, but it also can be boiler or evaporative surface) may be provided within the reactor enclosure 32 to provide the necessary heat absorption for the steam turbine cycle being used.

With this arrangement of dual, opposed furnace exits 40, the fuel and limestone feed is provided through the front 102 and rear 104 furnace enclosure walls 34. The solids 80 recycled from the secondary particle separator 78 (multiclone dust collector) are also injected through the front 102 and rear 104 walls. To provide better mixing in the lower furnace 36, the lower furnace 36 itself is split into two legs 112, 114, and secondary air nozzles 115 are installed in the front and rear of each leg 112, 114. For those fuels requiring a more uniform limestone distribution for effective sulfur capture, limestone injection 117 can be done from both sides (front and rear) of each leg 112, 114 or through the bottom of the furnace reactor enclosure 32. The primary air 44 for combustion and fluidization is supplied through windboxes 46 and distributor plates 48 installed near the bottom of each of these legs 112, 114. Provisions are made to equalize fuel and air inputs to each leg 112, 114. Each fuel feeder supplies fuel to both of the legs, and dampers (not shown but of known construction)in the primary and secondary air ducts are provided to supply combustion air proportional to the fuel input.

The flue gas and solids particles 56 flow upwardly through the furnace reactor enclosure 32 and out through the two opposed furnace exits 40 at the upper portion 38 thereof. In one preferred embodiment, these two exits 40 are, in turn, each fluidically connected to a convection pass 116 so as to provide the flue gas and solids particles 56 to heat exchanger surfaces located therein. Each of the convection passes 116 preferably comprise a first portion 118 wherein the heat exchanger surfaces located therein are arranged in substantially vertical pendant banks of tubes, and which is known as the pendant convection pass section 118. A second, downstream portion 120 of each of the convection passes preferably comprises a portion wherein the heat exchanger surfaces located therein are arranged in substantially horizontal banks of tubes, and is known as the horizontal convection pass section 120. Various types of heat exchanger surfaces can be positioned within these convection pass sections, including superheater 122, reheater 124, and economizer 126 surfaces, arranged in various combinations and orders with respect to the flow of flue gases and solids 56 thereacross. The particular arrangements of these types of heat exchanger surfaces depend upon the particular turbine cycles, gas and solids mass flows 56 and gas temperatures available at the furnace exits 40. In some cases the heating surface for a given type will be arranged entirely in the pendant convection pass 118, or entirely in the horizontal convection pass 120, or split having a portion of the heating surfaces in each section. While the mirror-image symmetry of the improved CFB reactor 100 can be extended to all of the heating surface structures in each convection pass 116, in that each convection pass 116 would carry the same type and arrangement of heating surfaces in the same order with respect to the flow of flue gases and solid particles 56, this is not required. It is possible that some arrangements might locate, for example, superheater surface 122 in one convection pass 116 and reheater surface 124 in the other convection pass 116, or that the particular physical structures of each type of heating surface in each convection pass 116 might not be exactly identical.

In each convection pass section 116, downstream of the last banks of heating surface, two sets of secondary particle separation means 78, each advantageously comprising a multiclone dust collector apparatus, would be provided to collect and recycle the last useful fractions of solids 80 from the flue gases 56 in each convection pass 116 for return to the lower portion 36 of the reactor enclosure 32.

Alternatively, the two furnace exits 40 may be connected to separate intermediate flue passages, having no heating surfaces therein, which eventually are combined into a single, common convection pass containing all the downstream heating surfaces. In this case, downstream of the last banks of heating surface in the common convection pass, a single secondary particle separation means, advantageously comprising a multiclone dust collector apparatus, would be provided to collect and recycle the last useful fractions of solids from the flue gases in the common convection pass for return to the lower portion 36 of the reactor enclosure 32.

Figure 5:
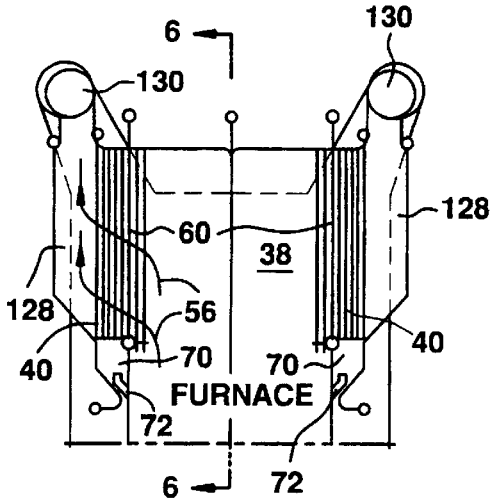
Figure 6:
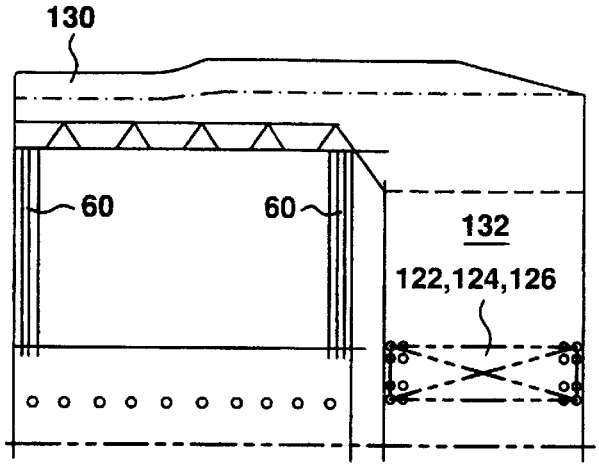
Figure 7:
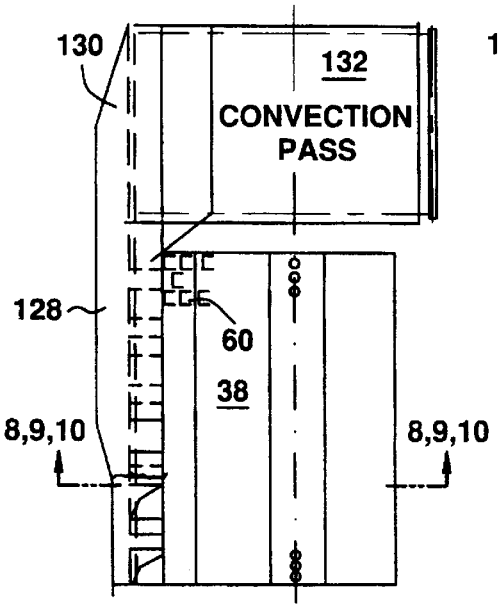

FIGS. 5–10 illustrate various configurations of the alternative arrangement mentioned in the paragraph above. FIG. 5 is a schematic sectional view of an upper portion 38 of the CFB reactor or combustor 30; FIG. 6 is a sectional view of FIG. 5 taken in the direction of arrows 6—6; and FIG. 7 is a schematic plan view, partly in section, of FIG. 5. After the flue gas/solids 56 pass across the impingement members 60 at each of the front and rear walls, they enter a flue portion 128 which is fluidically connected to the separate intermediate flue passages 130. Each of the separate intermediate flue passages 130 are combined into a single, common convection pass 132 containing all of the downstream heating surfaces, such as superheater 122, reheater 124, and economizer 126.

Figure 8:
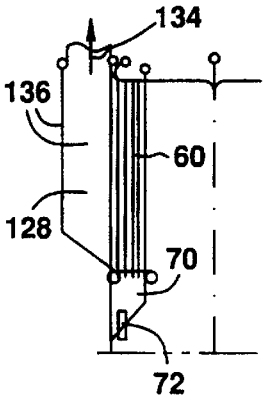
Figure 9:
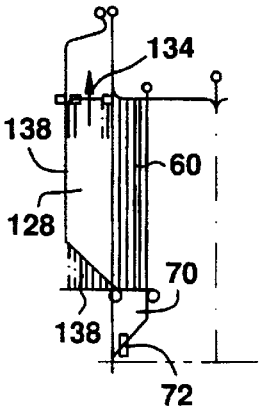
Figure 10:
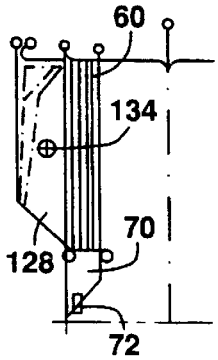

FIGS. 8, 9 and 10 are partial schematic sectional views of FIG. 7, taken in the direction of arrows 8—8, 9—9 and 10—10, respectively, and illustrate structural variations on how the flue gas/solids 56 could exit the flue portion 128 on their way to the separate intermediate flue passages 130 and single, common convection pass 132. In FIG. 8, flue gas/solids 56 exits upwardly in the direction of arrow 134, in a manner quite similar to FIG. 5, and also illustrates a construction wherein non-cooled plate 136 comprises the sides of flue portion 128. FIG. 9 is substantially the same as FIG. 8, except that fluid-cooled surface 138 comprises the sides of flue portion 128. Finally, FIG. 10 illustrates a construction wherein the flue gas/solids 56 exit through a side of flue portion 128. In FIG. 10, any of the sides may also be non-cooled plate 136 or fluid-cooled surface 128.

While specific embodiments of the invention have been shown and described in detail to illustrate the application of the principles of the invention, those skilled in the art will appreciate that changes may be made in the form of the invention covered by the following claims without departing from such principles. For example, the present invention may be applied to new construction involving circulating fluidized bed reactors or combustors. It is a particularly suitable, low pollution replacement for existing pulverized coal or other fossil-fueled steam generating apparatus, especially where a minimum boiler "footprint" or "boiler cell" area is available and yet significant steam generating capacity must still be provided. Examples of particular applications where the present invention can be employed are set forth in a Technical Paper entitled "REPOWERING OF UKRAINIAN POWER PLANTS WITH CFB BOILERS" co-authored by F. Belin, co-inventor of the present invention, along with J. Yu. Shang, M. M. Levin, and A. Yu. Maystrenko, to be presented at the PowerGen Americas '95 Conference in Anaheim, Calif., Dec. 5–7, 1995. The reader is thus referred to the text of that paper and it is the intention of Applicants to include the entire material from that paper into the present specification and this material is hereby incorporated by reference as though fully set forth herein, and appears in the file history of the present Provisional U.S. patent application by virtue of it being filed in the U.S. Patent and Trademark Office along with the specification of the present Provisional U.S. patent application. In some embodiments of the invention, certain features of the invention may sometimes be used to advantage without a corresponding use of the other features. Accordingly, all such changes and embodiments properly fall within the scope of the following claims.

We claim:

1. A circulating fluidized bed reactor, comprising:

a reactor enclosure defined by side, front and rear enclosure walls and having an unobstructed bottom portion, an unobstructed upper portion, and two exit openings, one exit opening located in the upper portion on the front enclosure wall and the other exit opening located in the upper portion on the rear enclosure wall;

primary, impact-type particle separator means located within the upper portion of the reactor enclosure at both exit openings, for collecting particles entrained in a gas flowing within the reactor enclosure from the lower portion to the upper portion thereof and causing the particles entrained with the gas flowing within the reactor enclosure to fall towards the bottom portion of the reactor enclosure;

particle-receiving means, connected to each of the primary, impact-type particle separator means at both exit openings, and located entirely within the upper portion of the reactor enclosure, for receiving collected particles as the collected particles fall from the primary, impact-type particle separator means; and returning means, particles connected to each of the particle-receiving means at both exit openings and located entirely within the reactor enclosure, for returning particles from the particle-receiving means directly and internally into the bottom portion of the reactor enclosure so that the received particles from the particle-receiving means free fall unobstructed and unchanneled down along the enclosure walls to the bottom portion of the reactor enclosure for subsequent recirculation.

2. The reactor of claim 1, further comprising means for supplying fuel and sorbent to the lower portion of the reactor enclosure.

3. The reactor of claim 1, further comprising a windbox 30 connected to the lower portion of the reactor enclosure.

4. The reactor of claim 1, wherein the primary, impact particle separator comprises rows of concave impingement members which are U-shaped, E-shaped, W-shaped or of some other concave configuration.

5. The reactor of claim 4, wherein the rows of concave impingement members are arranged in two groups, an upstream group and a downstream group, each group having at least two rows of concave impingement members.

6. The reactor of claim 1, wherein the CFB reactor is substantially symmetrical about a vertical centerline plane (P) passing through the side walls of the reactor enclosure.

7. The reactor of claim 1, further comprising at least one division wall heating surface and at least one wingwall heating surface located within the reactor enclosure.

8. The reactor of claim 1, further comprising a convection pass fluidically connected to both exit openings, for providing flue gases and entrained particles to heat exchanger surfaces located therein.

9. The reactor of claim 8, wherein the heat exchanger surfaces located within the convection pass comprise at least one superheater surface, at least one reheater surface, and at least one economizer surface.

10. The reactor of claim 1, further comprising a plurality of separate intermediate flue passages, each having an inlet, an outlet and no heating surfaces therein and each being fluidically connected at their respective inlets to an exit opening on at least one of the front enclosure wall and the rear enclosure wall, wherein the outlet of each separate intermediate flue passage is combined into a single, common convection pass containing downstream heating surfaces.

* * * * *